US005994470A

United States Patent [19]

Tanaka et al.

[11] Patent Number: 5,994,470

[45] **Date of Patent: *Nov. 30, 1999**

[54] GOLF BALL

[75] Inventors: Hiroaki Tanaka, Kobe; Yoshikazu Yabuki; Yoshinori Sano, both of Shirakawa, all of Japan

[73] Assignee: Sumitomo Rubber Industries, Ltd., Hyogo-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/569,992

[22] Filed: Dec. 8, 1995

[30] Foreign Application Priority Data

Dec. 8, 1994 [JP] Japan ..... 6-331819

[51] Int. Cl.[6] ..... A63B 37/12

[52] U.S. Cl. ..... 525/183; 525/92 A; 473/354; 473/365; 473/372; 473/385

[58] Field of Search ..... 473/385, 372, 473/354, 365; 525/183, 92 A

[56] References Cited

U.S. PATENT DOCUMENTS

| | | | |
|---|---|---|---|
| 3,819,768 | 6/1974 | Molitor | 525/221 |
| 4,690,981 | 9/1987 | Statz . | |
| 4,858,924 | 8/1989 | Saito . | |
| 4,884,814 | 12/1989 | Sullivan . | |
| 4,919,434 | 4/1990 | Saito . | |
| 5,155,157 | 10/1992 | Statz . | |
| 5,253,871 | 10/1993 | Viollaz | 525/175 |
| 5,586,950 | 12/1996 | Endo | 473/356 |

FOREIGN PATENT DOCUMENTS

| | | |
|---|---|---|
| 0341731 | 11/1989 | European Pat. Off. . |
| 06192512 | 7/1994 | Japan . |
| 192512 | 7/1994 | Japan . |

*Primary Examiner*—David Buttner
*Attorney, Agent, or Firm*—Birch, Stewart, Kolasch & Birch, LLP

[57] ABSTRACT

Disclosed is a golf ball having excellent shot feel, control properties as well as satisfactory flight performance and cut resistance. The golf ball of the present invention has a core and a cover for covering the core, wherein the cover has a stiffness modulus of 100 to 250 MPa, and is prepared from a resin composition comprising, as a base resin, a mixture of the following resin (A) and resin (B) in a weight ratio of 60:40 to 90:10:

resin (A): an ionomer resin (i) obtained by neutralizing with metal ion at least a part of carboxyl groups in a copolymer of ethylene and an α, β-unsaturated carboxylic acid, or a mixture of the ionomer resin (i) and an ionomer resin (ii) obtained by neutralizing with metal ion at least a part of carboxyl groups in a terpolymer of ethylene, an α, β-unsaturated carboxylic acid and an α, β-unsaturated carboxylate, and resin (B): a thermoplastic elastomer comprising a polyamide portion as a hard segment, having a Shore D hardness of 20 to 40 and a stiffness modulus of 10 to 50 MPa.

8 Claims, 2 Drawing Sheets

GOLF BALL

FIELD OF THE INVENTION

The present invention relates to a golf ball. More particularly, it relates to a golf ball having excellent shot feel and control properties as well as satisfactory flight performance and cut resistance.

BACKGROUND OF THE INVENTION

Recently, an ionomer resin has widely been used as a base resin for a cover of a golf ball (e.g. Japanese Patent Publication No. 49-27093). Particularly, the ionomer resin is exclusively used in a two-piece solid golf ball using a solid core. This is because the ionomer resin is superior in durability, cut resistance and rebound characteristics and, further, it is easily processed.

However, the ionomer resin is inferior in shot feel and control properties (ease of putting spin on the ball) in comparison with a balata used as a base resin for a cover of a thread wound golf ball, because the ionomer resin has a higher hardness and stiffness modulus.

Therefore, a trial has been conducted in order to improve the shot feel and controlling properties by softening the ionomer resin using various means.

For example, in order to improve shot feel and control properties, Japanese Laid-Open Patent Publication Nos. 1-308577 and 5-3913 suggest to soften a high-rigid ionomer resin by blending (mixing) an soft ionomer resin obtained by neutralizing a terpolymer of an α-olefin, an unsaturated carboxylic acid (e.g. acrylic acid, methacrylic acid, etc.) and an acrylate with sodium or zinc ion.

However, even if the soft ionomer resin as described above is blended, a shot feel similar to that of the golf ball with the balata cover has not been obtained. In addition, there is a problem that rebound characteristics and flight performance are deteriorated by blending the soft ionomer resin.

In addition, in Japanese Laid-Open Patent Publication No. 6-192512, it is suggested that rebound characteristics are improved while maintaining softness by using a mixture of an ionomer resin and a thermoplastic polyamide elastomer. Although the improving effect can also be admitted in view of the maintenance of softness according to this method, it is necessary to improve rebound characteristics and shot feel properties. This is because softness is obtained by increasing the mixing ratio of the thermoplastic polyamide elastomer and therefore the rebound characteristics are lowered a little.

As described above, the golf ball using the ionomer resin as the base resin of the cover is inferior in shot feel and control properties. In addition, the suggestions to improve these properties causes deterioration in rebound characteristics and flight performance and sufficient results have not been obtained.

OBJECTS OF THE INVENTION

Under these circumstances, the present inventors have intensively studied the base resin of the cover, in order to achieve excellent shot feel and control properties, which are similar to those of the golf ball with the balata cover, as well as flight performance and cut resistance due to the ionomer resin, simultaneously. As a result, it has been found that, by using a cover comprising a specific mixture of an ionomer resin and polyamide elastomer, a cover having excellent shot feel and control properties, which are similar to those of the golf ball with the balata cover, as well as excellent flight performance and cut resistance can be obtained.

The main object of the present invention is to provide a golf ball having excellent shot feel and control properties as well as flight performance and cut resistance.

This object as well as other objects and advantages of the present invention will become apparent to those skilled in the art from the following description with reference to the accompanying drawings.

SUMMARY OF THE INVENTION

Figure 1:
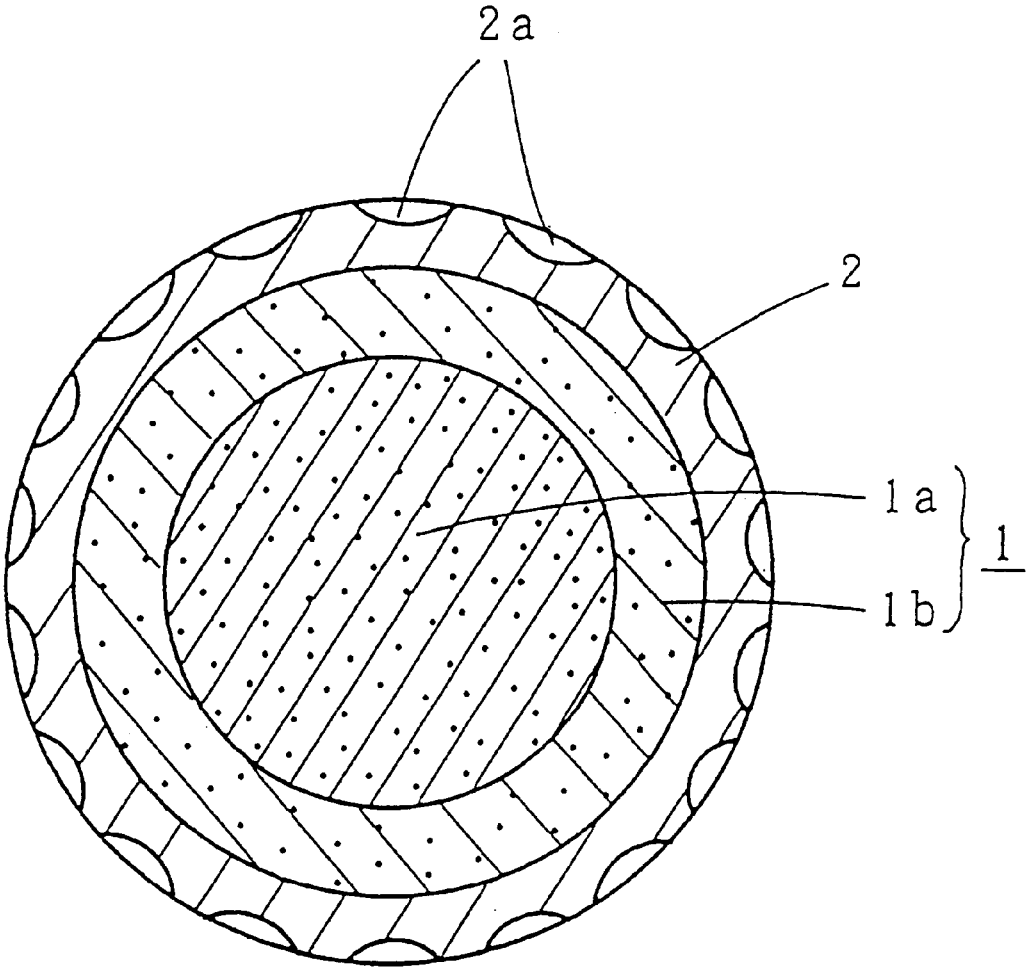
FIG. 1 is a schematic cross section illustrating one embodiment of the golf ball of the present invention.

The present invention provides a golf ball having a core and a cover for covering the core, wherein the cover has a stiffness modulus of 100 to 250 MPa, and is prepared from a resin composition comprising, as a base resin, a mixture of the following resin (A) and resin (B) in a weight ratio of 60:40 to 90:10:

resin (A): an ionomer resin (i) obtained by neutralizing with metal ion at least a part of carboxyl groups in a copolymer of ethylene and an α, β-unsaturated carboxylic acid, or a mixture of the ionomer resin (i) and an ionomer resin (ii) obtained by neutralizing with metal ion at least a part of carboxyl groups in a terpolymer of ethylene, an α, β-unsaturated carboxylic acid and an α, β-unsaturated carboxylate, and resin (B): a thermoplastic elastomer comprising polyamide portion as a hard segment, having a Shore D hardness of 20 to 40 and a stiffness modulus of 10 to 50 MPa.

DETAILED DESCRIPTION OF THE INVENTION

In the present invention, it is considered that the thermoplastic elastomer (B) comprising polyamide portion as a hard segment (hereinafter referred to as "polyamide elastomer") softens high rigidity of the ionomer resin (A) and provides excellent shot feel and control properties which are similar to those of the golf ball with the balata cover. The elastomer (B) does not deteriorate the flight performance and cut resistance of the ionomer resin (A), even when the thermoplastic polyamide elastomer (B) is mixed with the ionomer resin (A) to soften the ionomer resin.

In the present invention, the ionomer resin (i) in the above resin (A) is obtained by neutralizing with metal ion at least a part of carboxyl groups in a copolymer of ethylene and an α, β-unsaturated carboxylic acid, and the ionomer resin (ii) is obtained by neutralizing with metal ion at least a part of carboxyl groups in a terpolymer of ethylene, an α, β-unsaturated carboxylic acid and an ester of an α, β-unsaturated carboxylic acid.

The α, β-unsaturated carboxylic acid include acrylic acid, methacrylic acid, fumaric acid, maleic acid, crotonic acid, etc. Among them, acrylic acid and methacrylic acid are particularly preferred. Examples of the alkyl ester of α, β-unsaturated carboxylic acid are an alkyl ester of the above mentioned α, β-unsaturated carboxylic acid, such as alkyl acrylate, alkyl methacrylate, alkyl fumarate, alkyl maleate and the like. Examples of the alkyl groups are methyl, ethyl, propyl, n-butyl, isobutyl and the like. Among them, alkyl acrylate and alkyl methacrylate are particularly preferred. Examples of the metal ion for both the ionomer resins (i) and (ii) are ions of monovalent metal or divalent metal, such as sodium ion, lithium ion, zinc ion, magnesium ion, potassium ion, etc.

The ionomer resin (i) and ionomer resin (ii) are commercially available. Examples thereof are ionomer resins corresponding to the ionomer resin (i), such as Hi-milan 1605 (Na), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg), Hi-milan MK7320 (K), etc.; terpolymer ionomer resins corresponding to the ionomer resins (ii), such as Hi-milan 1856 (Na), Hi-milan 1855 (Zn), Hi-milan AM7316 (Zn), etc., all available from Mitsu Du Pont Polychemical Co., Ltd. Other examples commercially available from Du Pont U.S.A. Co. are ionomer resins corresponding to the ionomer resin (i), such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li), etc.; terpolymer ionomer resins corresponding to the ionomer resins (ii), such as Surlyn AD8265 (Na), Surlyn AD8269 (Na), etc. Examples commercially available from Exxon chemical Co. are ionomer resins corresponding to the ionomer resin (i), such as lotek 7010 (Zn), lotek 8000 (Na), etc. Na, Zn, K, Li, Mg, etc., which are described in parentheses at the back of the trade name of the above ionomer resin show neutralization metal ion species, respectively. In the present invention, as the resin (A), a mixture of an ionomer resin neutralized with the above described monovalent metal ion and an ionomer resin neutralized with the divalent metal ion may be used, or a mixture of ionomer resins neutralized with the monovalent metal ion or ionomer resins neutralized with the monovalent metal ion may be used.

A thermoplastic elastomer has both hard segment and soft segments in a molecule, but the resin (B) is a thermoplastic polyamide elastomer having a polyamide portion as a hard segment. The thermoplastic polyamide elastomer as the resin (B) has a Shore D hardness of 20 to 40 and a stiffness modulus of 10 to 50 MPa. Examples of the thermoplastic polyamide elastomer (B) are those commercially available from Toray Co., Ltd. under the trade name of Pebax.

When the Shore D hardness is smaller than 20 in the thermoplastic polyamide elastomer (B), the mixture with the ionomer resin (A) is too soft and rebound characteristics are deteriorated, which results in deterioration of flight performance. On the other hand, when the Shore D hardness is larger than 40, the ionomer resin (A) can not be soften sufficiently and good shot feel can not be obtained.

It is necessary that the thermoplastic polyamide elastomer (B) has a stiffness modulus of 10 to 50 MPa. When the stiffness modulus of the thermoplastic polyamide elastomer (B) is lower than 10 MPa, the mixture of the resin (A) and resin (B) is too soft and rebound characteristics are deteriorated, which results in deterioration of flight distance. On the other hand, when the stiffness modulus is higher than 50 MPa, the ionomer resin (A) is not softened sufficiently , which results in poor shot feel.

In the present invention, the mixing ratio of the resin (A) to the resin (B) is 60:40 to 90:10 (weight ratio), preferably 70:30 to 85:15. When the proportion of the ionomer resin as the resin (A) is larger than the above range, the properties of the ionomer resin (A) appear strongly, which results in inferior shot feel. On the other hand, when the proportion of the ionomer resin as the resin (A) is smaller than the above range, the cover is too soft and rebound characteristics are deteriorated, which results in deterioration of flight performance.

In the present invention, the base resin of the cover is composed of the ionomer resin as the resin (A) and thermoplastic polyamide elastomer as the resin (B). It is necessary that the cover containing the base resin has a stiffness modulus of 100 to 250 MPa. When the stiffness modulus of the cover is lower than 100 MPa, the cover is too soft and spin amount is too increased, which results in decrease of flight distance and deterioration of cut resistance. On the other hand, when the stiffness modulus is higher than 250 MPa, it is difficult to obtain a suitable backspin amount, which results in deterioration of control properties and shot feel. The cover of the present invention is mainly occupied by the mixture of the ionomer resin (A) and the thermoplastic polyamide elastomer (B). In many cases, a small amount of titanium dioxide, barium sulfate, etc. can be added and, therefore, the stiffness modulus is almost the same as that of the mixture of the ionomer resin (A) and the thermoplastic polyamide elastomer (B).

In the present invention, the mixing ratio of the ionomer resin as the resin (A) to the thermoplastic polyamide elastomer as the resins (B) is 60:40 to 90:10 (weight ratio). In that case, it is preferred to appropriately select the ionomer resin as the resin (A) or appropriately use the ionomer resin (i) in combination with the ionomer resin (ii) so that the stiffness modulus of the resulting cover may be 100 to 250 MPa.

In the present invention, it is possible to obtain desired characteristics by mixing the ionomer resin (A) with the thermoplastic polyamide elastomer (B). They are usually mixed with heating at a temperature of 150 to 250° C. for 0.5 to 15 minutes, using an internal mixer, such as a kneading type twin-screw extruder, a Banbury mixer, a kneader, etc.

If necessary, various additives such as pigments, dispersants, antioxidants, UV absorbers, photostabilizers, etc. can be formulated in the cover composition used for forming a cover in the present invention, in addition to the mixture of the resin (A) and the resin (B). In addition, other resin can also be added unless the properties of the mixture of the ionomer resin as the resin (A) and thermoplastic polyamide elastomer as the resin (B) are not deteriorated. When the other resin is added, the proportion of the mixture of the ionomer resin as the resin (A) and thermoplastic polyamide elastomer as the resin (B) is preferably not less than 70% by weight, particularly not less than 80% by weight. In the present invention, "the mixture of the ionomer resin as the resin (A) and thermoplastic polyamide elastomer as the resin (B) is used as a main component of the base resin of the cover" means a case that the base resin of the cover is composed of the mixture of the ionomer resin as the resin (A) and thermoplastic polyamide elastomer as the resin (B) alone and a case that the other resin is added to the above mixture to form the base resin of the cover. In the present invention, the ionomer resin (A) may be previously mixed with the thermoplastic polyamide elastomer (B), followed by mixing with the other resin. In addition, the mixture may be mixed with the other additives when the cover composition is prepared.

A golf ball can be obtained by covering a core with the cover. As the core, any of a core for solid golf ball (solid core) and a core for thread wound golf ball (thread wound core) can be used.

The sold core may be not only a core having uniform construction for a two-piece golf ball, but also a core having two or more layers for a multi layer golf ball. For example, as the core for a two-piece golf ball, those obtained by subjecting a rubber composition to a press vulcanization to compress with heating (e.g. at a temperature of 140 to 170° C. for 10 to 40 minutes) into a spherical vulcanized article can be used. The rubber composition may be prepared by formulating 10 to 60 parts by weight of at least one vulcanizing agent (crosslinking agent) of α, β-monoethylenically unsaturated carboxylic acids (e.g. acrylic acid, methacrylic acid, etc.) or metal salts thereof, or functional monomers (e.g. trimethylolpropane trimethacrylate, etc.), 10 to 30 parts by weight of a filler (e.g. zinc oxide, barium sulfate, etc.), 0.5 to 5 parts by weight of a peroxide (e.g. dicumyl peroxide, etc.) and 0.1 to 1 part by weight of an antioxidant, based on 100 parts by weight of polybutadiene.

The thread wound core is composed of a center and a thread rubber layer wound on the center. As the center, any of a liquid center and a rubber center can be used. As the rubber center, there can be used those obtained by vulcanizing the same rubber composition as that of the solid core.

The thread rubber may be those which have hitherto been used. For example, it is obtained by vulcanizing a rubber composition comprising an antioxidant, a vulcanizing accelerator, sulfur and a rubber component consisted of natural rubber or a mixture of natural rubber and synthetic polyisoprene. The core is not limited to the solid core and thread wound core.

A method of covering the cover on the core is not specifically limited, but may be a conventional method. For example, there can be used a method comprising molding a cover composition prepared by formulating a suitable amount of a requisite additive in the above mixture of the ionomer resin as the resin (A) and thermoplastic polyamide elastomer as the resin (B) into a semi-spherical half-shell in advance, covering a core with the two half-shells and then subjecting to a pressure molding at 130 to 170° C. for 1 to 15 minutes, or a method comprising subjecting the cover composition to an injection molding directly to cover the core. A thickness of the cover is normally about 1 to 4 mm. In case of cover molding, dimples may be formed on the surface of the ball, if necessary. Further, if necessary, a paint or marking may be provided after cover molding.

The structure of the golf ball of the present invention will be explained with reference to the accompanying drawing.

FIG. 1 is a schematic cross section illustrating one embodiment of the golf ball of the present invention. The golf ball shown in FIG. 1 is a thread wound golf ball. In FIG. 1, 1 is a core comprising a center 1*a* and a thread rubber 1*b*, 2 is a cover and 2*a* is a dimple.

The center 1*a* and thread rubber 1*b* are not specifically limited, and those which are similar to a conventional one can be used. As the center 1*a*, a liquid or rubber center may be used. The thread rubber 1*b* is wound around the center 1*a* in a stretched state, thereby forming a core 1 referred to as a thread wound core. The cover 2 is for covering the core 1. This cover 2 is formed from the cover composition, which contains the ionomer resin as the resin (A) and thermoplastic polyamide elastomer as the resin (B).

Figure 2:
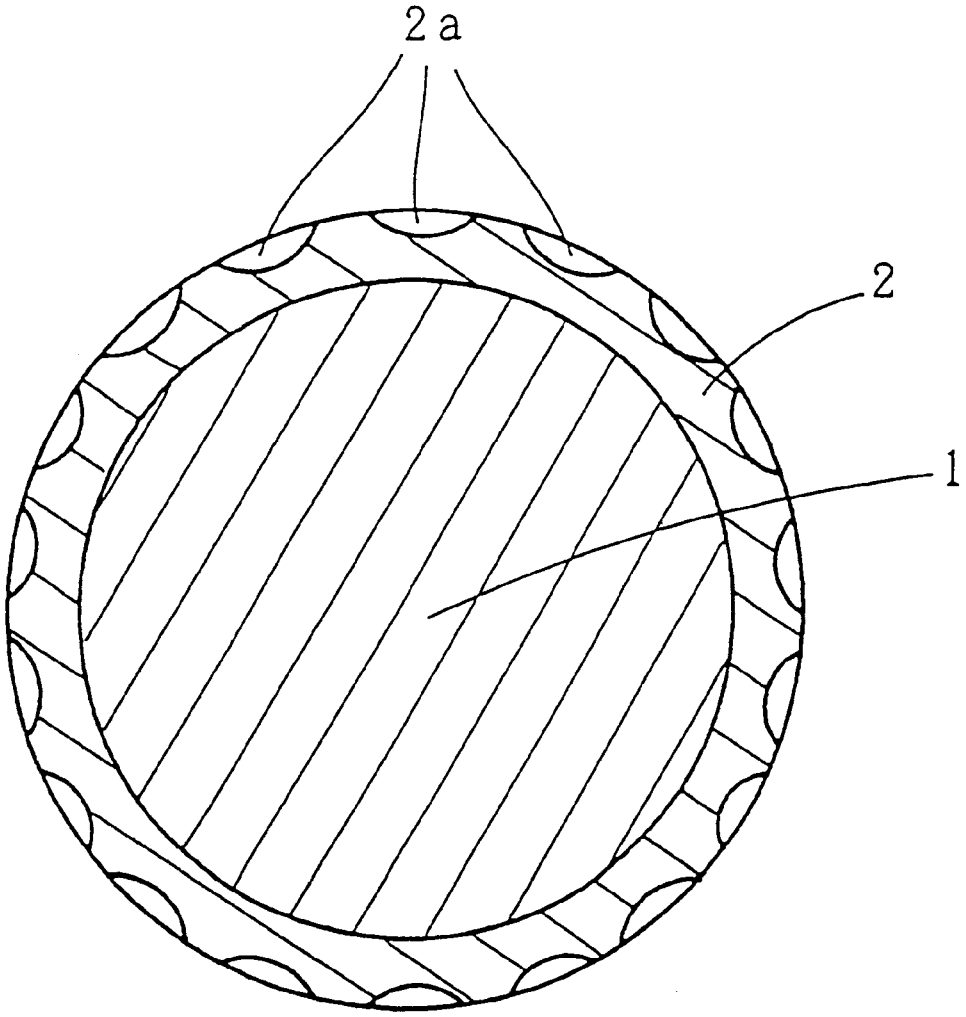
FIG. 2 is a schematic cross section illustrating another embodiment of the golf ball of the present invention.

FIG. 2 is a schematic cross section illustrating another embodiment of the golf ball of the present invention. The golf ball shown in FIG. 2 is a two-piece solid golf ball comprising a core 1 and a cover 2 for covering the core. The core 1 is referred to as a solid core but is not specifically limited, for example, a vulcanized product of a rubber composition comprising polybutadiene as a main material as described above. The cover 2 for covering the core is a cover composition, which contains the above mixture of the ionomer resin as the resin (A) and thermoplastic polyamide elastomer as the resin (B). In addition, 2*a* is a dimple provided on the cover 2. In the golf ball shown in FIG. 2, the core 1 is composed of a vulcanized molded product of a single-layer rubber, but it may also be a two-layer solid core obtained by further forming an outer core of a vulcanized molded product of a rubber composition comprising polybutadiene as a main material around an inner core of a vulcanized molded product of a rubber composition comprising polybutadiene as a main material.

A suitable number/embodiment of dimples 2*a* are optionally provided on the cover 2 of the golf ball so that desired characteristics may be obtained. In addition, painting or marking is optionally provided on the surface of the golf ball.

As described above, according to the present invention, there is provided a golf ball having excellent shot feel, control properties, spin characteristics and durability as well as satisfactory flight performance and cut resistance.

EXAMPLES

The following Examples and Comparative Examples further illustrate the present invention in detail but are not to be construed to limit the scope thereof.

Examples 1 to 8 and Comparative Examples 1 to 8 (thread wound golf ball)

Thread wound golf balls of Examples 1 to 8 and Comparative Examples 1 to 8 were produced through the following processes (1) to (3).

(1) Production of Core

A thread wound core having an outer diameter of 39.5 mm was produced by winding a thread rubber comprising a natural rubber/low-cis isoprene rubber [Shell IR-309 (trade name)](=50:50) as the base rubber on a liquid center having an outer diameter of 28.1 mm. The liquid center contained a paste obtained by dispersing barium sulfate in water and a center bag of a vulcanized natural rubber having a thickness of 1.7 mm, which covered the paste.

(2) Production of a Cover Composition

The formulation components shown in Tables 1 to 4 were mixed using a kneading type twin-screw extruder to obtain a pelletized cover composition. The components of the cover compositions of Preparation Examples 1 to 4 to be used for the golf balls of Examples 1 to 4 and the stiffness modulus of the cover are shown in Table 1. The components of the cover compositions of Preparation Examples 5 to 8 to be used for the golf balls of Examples 5 to 8 and the stiffness modulus of the cover are shown in Table 2. The components of the cover compositions of Comparative Preparation Examples 1 to 4 to be used for the golf balls of Comparative Examples 1 to 4 and the stiffness modulus of the cover are shown in Table 3, respectively. The components of the cover compositions of Comparative Preparation Examples 5 to 8 to be used for the golf balls of Comparative Examples 5 to 8 and the stiffness modulus of the cover are shown in Table 4. In addition, the amount of each component to be formulated in the tables is represented by parts by weight, and it is also the same in the following tables. In the tables, the ionomer resin as the resin (A) and the thermoplastic polyamide elastomer as the resin (B) are represented by the trade name, and the details will be explained at the back of Table 4 in order. Regarding Comparative Preparation Example 8 to be used as the cover composition of the golf ball of Comparative Example 8, the formulation component is not shown in Table 4 and is shown at the back of Table 8 as *16 because of its balata cover.

The extrusion conditions are as follows: a screw diameter: 45 mm; a screw revolution per minute: 200 rpm; a screw L/D=35. The formulation components were heated at 220 to 260° C. at the die position of the extruder. The measuring methods of the stiffness modulus and Shore D hardness are as follows.

Stiffness modulus: It is measured according to ASTM D-747 after a sheet having a thickness of about 2 mm obtained by heat-press molding was preserved at 23° C. for two weeks.

Shore D hardness: It is measured according to ASTM D-2240 after a sheet having a thickness of about 2 mm obtained by heat-press molding was preserved at 23° C. for two weeks.

Among the cover compositions of Comparative Preparation Examples 1 to 8 to be used for the cover of the golf balls of Comparative Examples 1 to 8, typical one will be explained. The composition of Comparative Preparation Example 1 is a cover composition wherein only a high-rigid ionomer resin is used as the base resin, and the cover composition of Comparative Preparation Example 1 corresponds to a conventional standard composition for ionomer cover. In addition, the cover composition of Comparative Preparation Example 8 is a standard composition for balata cover. The golf ball of Comparative Example 1 wherein the cover composition of Comparative Preparation Example 1 is used and golf ball of Comparative Example 8 wherein the cover composition of Comparative Preparation Example 8 is used are golf balls for a criterion of comparison.

(3) Production of Golf Ball

A thread wound golf ball was obtained by molding a semi-spherical half-shell from the cover composition of the above item (2) covering the core of the item (1) with two half-shells and then subjecting to a press molding in a die for the golf ball at 150° C. for 6 minutes. The thread wound golf ball was coated with a paint to give a coated golf ball of 42.7 mm in outer diameter. Regarding the golf ball of Comparative Example 8, a thread wound golf ball was produced by pressing at 90° C. for 6 minutes and vulcanizing at 35° C. for 48 hours as shown in *16.

The ball weight, the ball compression, the ball initial velocity and the flight distance of the golf ball thus obtained were measured. The ball compression was measured by the PGA method, and the ball initial velocity was measured by the R & A initial velocity measuring method. The flight distance was measured by hitting with a No. 1 wood club at a head speed of 45 m/second, using a swing robot manufactured by True Temper Co. Spin was measured by hitting with a No. 9 iron club at a head speed of 34 m/second, using a swing robot manufactured by True Temper Co., and then taking a photograph of the hit golf ball.

Furthermore, in order to examine the cut resistance of the golf balls of the Examples 1 to 8 and Comparative Examples 1 to 8, the top part of the golf ball was hit at a head speed of 30 m/second using a swing robot mounted with a pitching wedge manufactured by True Temper Co. to examine whether a cut mark is arisen or not. The evaluation criteria are as follows.

Evaluation criteria

○: No cut mark is formed.

Δ: Slight cut mark is formed.

X: Large cut mark is formed.

XX: Large cut mark which can not stand use is formed.

Further, in order to examine the durability of the above golf ball, a golf ball was hit with a No. 1 wood club at a head speed of 45 m/second using a swing robot manufactured by True Temper Co., and the number of times until breakage was arisen was measured. The resulting value was indicated as a durability index in case of the number of Example 1 being 100.

Further, the shot feel and the control properties of the resulting golf ball were evaluated by 10 top professional golfers according to a practical hitting test. The evaluation criteria are as follows. The results shown in the Tables below are based on the fact that not less than 8 out of 10 professional golfers evaluated with the same criterion about each test item.

Evaluation criteria

○: Good, shot feel and control properties are similar to those of the golf ball with the balata cover.

Δ: Control properties are similar to those of the golf ball with the balata cover, but shot feel is quite different from that of the golf ball with the balata cover, that is, it is too heavy, which results in too strong impact, or it is too soft, which results in heavy feeling.

X: Both shot feel and control properties are inferior.

In Table 5, the ball weight, ball compression, ball initial velocity, flight distance, spin, cut resistance, durability, shot feel and control properties of the golf balls of Examples 1 to 4, and the kind of the composition for the cover used in the production of the golf ball are shown. Those of the gold balls of Examples 5 to 6, those of the golf balls of Comparative Examples 1 to 4 and those of the golf balls of Comparative Examples 5 to 8 are shown in Tables 6, 7 and 8, respectively.

TABLE 1

| | | Preparation Example No. | | | |
|---|---|---|---|---|---|
| | | 1 | 2 | 3 | 4 |
| Hi-milan 1605 | *1 | 25 | 22.5 | 0 | 0 |
| Hi-milan 1707 | *2 | 0 | 0 | 20 | 0 |
| Hi-milan AM7318 | *3 | 0 | 0 | 0 | 20 |
| Hi-milan 1856 | *4 | 0 | 0 | 0 | 40 |
| Hi-milan 1706 | *5 | 25 | 22.5 | 20 | 0 |
| Hi-milan AM7317 | *6 | 0 | 0 | 0 | 20 |
| Hi-milan 1855 | *7 | 35 | 40 | 40 | 0 |
| Pebax 3533 | *14 | 15 | 0 | 0 | 20 |
| Pebax 2533 | *15 | 0 | 15 | 20 | 0 |
| Titanium dioxide | | 2 | 2 | 2 | 2 |
| Barium sulfate | | 2 | 2 | 2 | 2 |
| Stiffness modulus (MPa) | | 170 | 150 | 120 | 190 |

TABLE 2

| | | Preparation Example No. | | | |
|---|---|---|---|---|---|
| | | 5 | 6 | 7 | 8 |
| Hi-milan 1706 | *5 | 25 | 0 | 30 | 0 |
| Hi-milan AM7317 | *6 | 0 | 0 | 0 | 30 |
| Hi-milan 1855 | *7 | 35 | 0 | 10 | 25 |
| Hi-milan MK7320 | *8 | 25 | 0 | 0 | 0 |
| Surlyn AD8512 | *9 | 0 | 25 | 0 | 0 |
| Surlyn AD8269 | *10 | 0 | 10 | 0 | 0 |
| Surlyn AD8511 | *11 | 0 | 25 | 0 | 0 |
| Surlyn 7940 | *12 | 0 | 0 | 30 | 0 |
| Iotek 8000 | *13 | 0 | 0 | 0 | 30 |
| Pebax 2533 | *15 | 15 | 40 | 30 | 15 |
| Titanium dioxide | | 2 | 2 | 2 | 2 |
| Barium sulfate | | 2 | 2 | 2 | 2 |
| Stiffness modulus (MPa) | | 160 | 100 | 210 | 240 |

TABLE 3

| | | Comparative Preparation Example No. | | | |
|---|---|---|---|---|---|
| | | 1 | 2 | 3 | 4 |
| Hi-milan 1605 | *1 | 50 | 30 | 0 | 0 |
| Hi-milan AM7318 | *3 | 0 | 0 | 25 | 0 |
| Hi-milan 1706 | *5 | 50 | 30 | 0 | 60 |
| Hi-milan AM7317 | *6 | 0 | 0 | 25 | 0 |
| Hi-milan 1855 | *7 | 0 | 0 | 0 | 40 |
| Surlyn AD8269 | *10 | 0 | 40 | 50 | 0 |
| Titanium dioxide | | 2 | 2 | 2 | 2 |
| Barium sulfate | | 2 | 2 | 2 | 2 |
| Stiffness modulus (MPa) | | 340 | 160 | 200 | 180 |

TABLE 4

| | | Comparative Preparation Example No. | | | |
|---|---|---|---|---|---|
| | | 5 | 6 | 7 | 8 |
| Hi-milan 1605 | *1 | 15 | 75 | 45 | Balata cover *16 |
| Hi-milan 1706 | *5 | 15 | 25 | 50 | |
| Hi-milan 1855 | *7 | 70 | 0 | 0 | |
| Pebax 2533 | *15 | 0 | 0 | 5 | |
| Titanium dioxide | | 2 | 2 | 2 | |
| Barium sulfate | | 2 | 2 | 2 | |
| Stiffness modulus (MPa) | | 150 | 90 | 300 | 300 |

*1: Hi-milan 1605 (trade name), ethylene-methacrylic acid copolymer ionomer resin obtained by neutralizing with a sodium ion, manufactured by Mitsui Du Pont Polychemical Co., MI (melt index): 2.8, stiffness modulus: 310 MPa, Shore D hardness: 62

*2: Hi-milan 1707 (trade name), ethylene-methacrylic acid copolymer ionomer resin obtained by neutralizing with a sodium ion, manufactured by Mitsui Du Pont Polychemical Co., MI: 0.9, stiffness modulus: 320 MPa, Shore D hardness: 63

*3: Hi-milan AM7318 (trade name), ethylene-methacrylic acid copolymer ionomer resin obtained by neutralizing with a sodium ion, manufactured by Mitsui Du Pont Polychemical Co., MI: 2.1, stiffness modulus: 345 MPa, Shore D hardness: 65

*4: Hi-milan 1856 (trade name), ethylene-butyl acrylate-methacrylic acid three-dimensional polymer ionomer resin obtained by neutralizing with a sodium ion, manufactured by Mitsui Du Pont Polychemical Co., MI: 1.0, stiffness modulus: 85 MPa, Shore D hardness: 53

*5: Hi-milan 1706 (trade name), ethylene-methacrylic acid copolymer ionomer resin obtained by neutralizing with a zinc ion, manufactured by Mitsui Du Pont Polychemical Co., MI: 0.8, stiffness modulus: 260 MPa, Shore D hardness: 61

*6: Hi-milan AM7317 (trade name), ethylene-methacrylic acid copolymer ionomer resin obtained by neutralizing with a zinc ion, manufactured by Mitsui Du Pont Polychemical Co., MI: 1.2, stiffness modulus: 310 MPa, Shore D hardness: 64

*7: Hi-milan 1855 (trade name), ethylene-butyl acrylate-methacrylic acid terpolymer ionomer resin obtained by neutralizing with a zinc ion, manufactured by Mitsui Du Pont Polychemical Co., MI: 1.0, stiffness modulus: 90 MPa, Shore D hardness: 55

*8: Hi-milan MK7320 (trade name), ethylene-methacrylic acid copolymer ionomer resin obtained by neutralizing with a potassium ion, manufactured by Mitsui Du Pont Polychemical Co., MI: 2.8, stiffness modulus: 290 MPa, Shore D hardness: 61

*9: Surlyn AD8512 (trade name), ethylene-methacrylic acid copolymer ionomer resin obtained by neutralizing with a sodium ion, manufactured by Du Pont Co., MI: 4.4, stiffness modulus: 280 MPa, Shore D hardness: 62

*10: Surlyn AD8269 (trade name), ethylene-butyl acrylate-methacrylic acid terpolymer resin obtained by neutralizing with a zinc ion, manufactured by Du Pont Co., MI: 1.0, stiffness modulus: 26 MPa, Shore D hardness: 36

*11: Surlyn AD8511 (trade name), ethylene-methacrylic acid copolymer ionomer resin obtained by neutralizing with a zinc ion, manufactured by Du Pont Co., MI: 3.4, stiffness modulus: 220 MPa, Shore D hardness: 60

*12: Surlyn 7940 (trade name), ethylene-methacrylic acid copolymer ionomer resin obtained by neutralizing with a lithium ion, manufactured by Du Pont Co., MI: 2.8, stiffness modulus: 350 MPa, Shore D hardness: 63

*13: Iotek 8000 (trade name), ethylene-acrylic acid copolymer ionomer resin obtained by neutralizing with a sodium ion, manufactured by Exxon Chemical Co., MI: 0.8, stiffness modulus: 370 MPa, Shore D hardness: 64

TABLE 4-continued

*14: Pebax 3533 (trade name), thermoplastic polyamide elastomer of polyether-polyamide block copolymer, manufactured by Toray Co. Ltd., MI: 7, Shore D hardness: 35

*15: Pebax 2533 (trade name), thermoplastic polyamide elastomer of polyether-polyamide block copolymer, manufactured by Toray Co. Ltd., MI: 6, Shore D hardness: 25

*16: Balata cover, a conventional composition for balata cover, prepared by mixing 10 parts by weight of a natural rubber, 10 parts by weight of a high-styrene resin, 10 parts by weight of titanium dioxide, 5 parts by weight of zinc oxide, 2 parts by weight of sulfur and 2 parts by weight of a vulcanization accelerator with 100 parts by weight of balata (transpolyisoprene) using a roll and extrudinginto a sheet form by calendaring, and after molding into a cover, vulcanizing at 35° C. for 48 hours.

TABLE 5

| | Example No. | | | |
|---|---|---|---|---|
| | 1 | 2 | 3 | 4 |
| Cover composition (Preparation Example No.) | 1 | 2 | 3 | 4 |
| Ball weight (g) | 45.4 | 45.4 | 45.3 | 45.3 |
| Ball compression (PGA) | 85 | 85 | 82 | 89 |
| Ball initial velocity (feet/second) | 252.7 | 252.7 | 252.1 | 253.2 |
| Flight distance (yard) | 228 | 228 | 227 | 228 |
| Spin (rpm) | 8450 | 8450 | 8300 | 8600 |
| Cut resistance | ○ | ○ | ○ | ○ |
| Durabitity (index) | 100 | 100 | 130 | 95 |
| Shot feel and control properties | ○ | ○ | ○ | ○ |

TABLE 6

| | Example No. | | | |
|---|---|---|---|---|
| | 5 | 6 | 7 | 8 |
| Cover composition (Preparation Example No.) | 5 | 6 | 7 | 8 |
| Ball weight (g) | 45.3 | 45.4 | 45.4 | 45.3 |
| Ball compression (PGA) | 88 | 80 | 87 | 90 |
| Ball initial velocity (feet/second) | 253.0 | 251.7 | 252.8 | 253.4 |
| Flight distance (yard) | 227 | 227 | 228 | 227 |
| Spin (rpm) | 8550 | 8200 | 8600 | 8600 |
| Cut resistance | ○ | ○ | ○ | ○ |
| Durabitity (index) | 98 | 160 | 95 | 90 |
| Shot feel and control properties | ○ | ○ | ○ | ○ |

TABLE 7

| | Comparative Example No. | | | |
|---|---|---|---|---|
| | 1 | 2 | 3 | 4 |
| Cover composition (Comparative Preparation Example No.) | 1 | 2 | 3 | 4 |
| Ball weight (g) | 45.3 | 45.3 | 45.4 | 45.3 |
| Ball compression (PGA) | 92 | 87 | 88 | 88 |
| Ball initial velocity (feet/second) | 253.0 | 251.0 | 251.2 | 251.1 |
| Flight distance (yard) | 230 | 222 | 223 | 222 |
| Spin (rpm) | 7000 | 7900 | 7700 | 7800 |
| Cut resistance | ○ | ○ | ○ | ○ |
| Durability (index) | 60 | 97 | 90 | 85 |
| Shot feel and control properties | X | ○ | Δ | Δ |

TABLE 8

| | Comparative Example No. | | | |
|---|---|---|---|---|
| | 5 | 6 | 7 | 8 |
| Cover composition (Comparative Praparation Example No.) | 5 | 6 | 7 | 8 |
| Ball weight (g) | 45.4 | 45.4 | 45.3 | 45.3 |
| Ball compression (PGA) | 86 | 92 | 85 | 87 |
| Ball initial velocity (feet/second) | 250.8 | 252.8 | 249.8 | 251.0 |
| Flight distance (yard) | 221 | 229 | 219 | 223 |
| Spin (rpm) | 7950 | 7200 | 8800 | 8500 |
| Cut resistance | Δ | Δ | ○ | XX |
| Durability (index) | 88 | 65 | 90 | 40 |
| Shot feel and control properties | Δ | X | ○ | ○ |

As is apparent from a comparison between the characteristics of the golf balls of Examples 1 to 8 shown in Tables 5 to 6 and those of the golf balls of Comparative Examples 1 to 8 shown in Tables 7 to 8, all golf balls of Examples 1 to 8 had excellent shot feel, control properties and spin characteristics, which are similar to those of the golf balls with the balata cover of Comparative Example 8. And besides, they attained the flight distance of 227 to 228 yards, which is almost the same as that of the golf ball as the thread wound golf ball with a standard ionomer cover of Comparative Example 1. The cut resistance is also the same as that of the golf ball of Comparative Example 1 and it reached a satisfactory level. In addition, the golf balls of Examples 1 to 8 were considerably superior in durability in comparison with the golf ball of Comparative Example 1.

To the contrary, the golf ball of Comparative Example 1 as the thread wound golf ball with a standard ionomer cover using only a high-rigid ionomer resin as the cover resin of the cover showed a hard shot feel and was inferior in control properties.

In addition, the golf ball of Comparative Example 2 using the mixture of the high-rigid ionomer resin and terpolymer soft ionomer resin as the base resin of the cover was superior in shot feel, control properties and spin characteristics, however, the flight distance was small. Regarding the golf balls of Comparative Examples 3 to 5 using the mixture of the high-rigid ionomer resin and terpolymer soft ionomer resin as the base resin of the cover, the spin characteristics and control properties were similar to those of the golf ball with the balata cover but the shot feel was not satisfactory. And besides, the flight distance was 221 to 223 and was considerably inferior in comparison with that of the golf balls of Examples 1 to 8.

In addition, the golf ball of Comparative Example 6 using only the mixture of the high-rigid ionomer resin as the base resin of the cover (the mixing proportion is different with that of Comparative Example 1) was also inferior in shot feel and control properties. In addition, the golf ball of Comparative Example 7 wherein the proportion of the thermoplastic polyamide elastomer as the component (B) is small showed a small initial velocity and a large spin amount in comparison with the golf balls of Examples 1 to 8 and, therefore, the flight distance was small. In addition, the golf ball of Comparative Example 8 as the thread wound golf ball with a standard balata cover was superior in shot feel, control properties and spin characteristics. However, the flight distance was 223 yards, which was considerably inferior in comparison with the golf balls of Examples 1 to 8. Particularly, the cut resistance and durability were considerably inferior.

Examples 9 to 16 and Comparative Examples 8 to 15 (two-piece solid golf ball)

(1) Production of Core

A rubber composition prepared by formulating 36 parts by weight of zinc acrylate, 20 parts by weight of zinc oxide, 1.2 parts by weight of dicumyl peroxide and 0.5 parts by weight of an antioxidant [Yoshinox 425 (trade name), manufactured by Yoshitomi Seiyaku Co., Ltd.] in 100 parts by weight of a polybutadiene rubber [BR-11 (trade name), manufactured by Japan Synthetic Rubber Co., Ltd] was subjected to a vulcanization molding at 160° C. for 25 minutes to give a solid core. The average diameter of the solid core thus obtained was 38.2 mm.

(2) Preparation of Cover Composition

The pelletized compositions for the cover prepared in Preparation Examples 1 to 8 and Comparative Preparation Examples 1 to 7 were used.

(3) Production of Golf Ball

The composition for the cover obtained in the above item (2) was covered on the solid core obtained in the above item (1) by an injection molding to give a coated golf ball of 42.7 mm in diameter.

The ball weight, ball compression, ball initial velocity, flight distance, cut resistance and durability of the golf ball thus obtained were measured and, further, the shot feel and the control properties were examined.

In Table 9, the ball weight, ball compression, ball initial velocity, flight distance, spin performances, cut resistance, durability, shot feel and control properties of the golf balls of Examples 9 to 12, and the kind of the cover composition used in the production of the golf ball are shown. Those of the golf balls of Examples 13 to 16, those of Comparative Examples 9 to 12 and those of the golf balls of Comparative Examples 13 to 15 are shown in Table 10, Table 11 and Table 12, respectively. The kind of the cover composition is shown by Preparation Example No. or Comparative Preparation Example No.

TABLE 9

| | Example No. | | | |
|---|---|---|---|---|
| | 9 | 10 | 11 | 12 |
| Cover composition (Preparation Example No.) | 1 | 2 | 3 | 4 |
| Ball weight (g) | 45.4 | 45.4 | 45.3 | 45.3 |
| Ball compression (PGA) | 89 | 89 | 86 | 93 |
| Ball initial velocity (feet/second) | 253.1 | 253.0 | 252.7 | 253.5 |
| Flight distance (yard) | 233 | 232 | 231 | 234 |
| Spin (rpm) | 8200 | 8250 | 8400 | 8150 |
| Cut resistance | ○ | ○ | ○ | ○ |
| Durability | 100 | 100 | 105 | 90 |
| Shot feel and control properties | ○ | ○ | ○ | ○ |

TABLE 10

| | Example No. | | | |
|---|---|---|---|---|
| | 13 | 14 | 15 | 16 |
| Cover composition (Preparation Example No.) | 5 | 6 | 7 | 8 |
| Ball weight (g) | 45.3 | 45.4 | 45.4 | 45.3 |
| Ball compression (PGA) | 92 | 84 | 93 | 94 |
| Ball initial velocity (feet/second) | 253.3 | 252.5 | 253.6 | 253.7 |
| Flight distance (yard) | 233 | 231 | 234 | 234 |
| Spin (rpm) | 8100 | 8300 | 8150 | 8100 |
| Cut resistance | ○ | ○ | ○ | ○ |
| Durability | 95 | 110 | 95 | 95 |
| Shot feel and control properties | ○ | ○ | ○ | ○ |

TABLE 11

| | Comparative Example No. | | | |
|---|---|---|---|---|
| | 9 | 10 | 11 | 12 |
| Cover composition (Comparative Preparation Example No.) | 1 | 2 | 3 | 4 |
| Ball weight (g) | 45.3 | 45.3 | 45.4 | 45.3 |
| Ball compression (PGA) | 94 | 91 | 92 | 92 |
| Ball initial velocity (feet/second) | 253.3 | 251.3 | 251.5 | 251.5 |
| Flight distance (yard) | 233 | 225 | 226 | 226 |
| Spin (rpm) | 6800 | 7700 | 7500 | 7450 |
| Cut resistance | ○ | ○ | ○ | ○ |
| Durability | 60 | 87 | 90 | 85 |
| Shot feel and control properties | X | Δ | Δ | Δ |

TABLE 12

| | Comparative Example No. | | |
|---|---|---|---|
| | 13 | 14 | 15 |
| Cover composition (Comparative Preparation Example No.) | 5 | 7 | 8 |
| Ball weight (g) | 45.4 | 45.3 | 45.4 |
| Ball compression (PGA) | 90 | 87 | 94 |
| Ball initial velocity (feet/second) | 251.3 | 249.0 | 253.1 |
| Flight distance (yard) | 225 | 223 | 232 |
| Spin (rpm) | 7800 | 8500 | 7000 |
| Cut resistance | ○ | Δ | ○ |
| Durability (index) | 88 | 90 | 65 |
| Shot feel and control properties | Δ | Δ | X |

As is apparent from a comparison between the characteristics of the golf balls of Examples 9 to 16 shown in Tables 9 to 10 and those of the golf balls of Comparative Examples 9 to 15 shown in Tables 11 to 12, the two-piece solid golf balls of the Examples 9 to 16 of the present invention had excellent shot feel, control properties and spin characteristics, which are similar to those of the thread wound golf balls of the Examples 1 to 8. And besides, they attained the flight distance of 231 to 234 yards, which is almost the same as that of the two-piece golf ball with a standard ionomer cover of Comparative Example 9, and reached a satisfactory level in cut resistance.

To the contrary, the golf ball of Comparative Example 9 as the two-piece solid golf ball with a standard ionomer cover using only a high-rigid ionomer resin as the base resin of the cover was superior in flying performance and cut resistance, but the shot feel and the control properties were inferior. The golf balls of the Comparative Examples 10 to 15 were inferior in shot feel, control properties and durability, but the flight distance was considerably inferior in comparison with the golf balls of the Examples 9 to 16.

What is claimed is:

1. A golf ball having a core and a single layer cover for covering the core, wherein said cover has a stiffness modulus of 100 to 250 MPa, and is prepared from a resin composition comprising, as a base resin, a mixture of the following resin (A) and resin (B) in a weight ratio of 60:40 to 90:10:

resin (A): an ionomer resin (i) obtained by neutralizing with metal ion at least a part of carboxyl groups in a copolymer of ethylene and an α, β-unsaturated carboxylic acid, or a mixture of the ionomer resin (i) and an ionomer resin (ii) obtained by neutralizing with metal ion at least a part of carboxyl groups in a terpolymer of ethylene, an α, β-unsaturated carboxylic acid and an α, β-unsaturated carboxylate, and resin (B): a thermoplastic elastomer which is a polyether-polyamide block copolymer comprising a polyamide portion as a hard segment and a polyether component as a soft segment, having a Shore D hardness of 20 to 40 and a stiffness modulus of 10 to 50 MPa.

2. The golf ball according to claim 1, wherein the resin (A) is a mixture of an ionomer resin neutralized with a monovalent metal ion and an ionomer resin neutralized with a divalent metal ion.

3. The golf ball according to claim 2, wherein the α, β-unsaturated carboxylate is alkyl acrylate or alkyl methacrylate.

4. The golf ball according to claim 1 wherein said core is either a solid core or a thread wound core.

5. The golf ball according to claim 1, wherein the mixing ratio of resin (A) to the thermoplastic polyamide elastomer resin (B) is 70:30 to 85:15.

6. The golf ball according to claim 1, wherein the α, β-unsaturated carboxylic acid is acrylic acid or methacrylic acid.

7. The golf ball according to claim 1, wherein the α, β-unsaturated carboxylate is alkyl acrylate or alkyl methacrylate.

8. The golf ball according to claim 1, further comprising a paint coating over the cover of the golf ball.

* * * * *